1/24/84 XR 4,426,935

United States Patent [19]

Nikoden, Jr.

[11] 4,426,935

[45] Jan. 24, 1984

[54] CASE FOR SECURING VALUABLES

[75] Inventor: Joseph Nikoden, Jr., Palatine, Ill.

[73] Assignee: Detroit-Armor Corporation, Schaumburg, Ill.

[21] Appl. No.: 391,306

[22] Filed: Jun. 23, 1982

[51] Int. Cl.[3] ..... A47B 47/02; E04H 9/00

[52] U.S. Cl. ..... 109/79; 312/257 SM; 109/85

[58] Field of Search ..... 109/49, 74, 78, 79, 109/80, 85; 312/100, 257 SM

[56] References Cited

U.S. PATENT DOCUMENTS

| | | | |
|---|---|---|---|
| 828,133 | 8/1906 | Morrison | 109/79 X |
| 2,274,106 | 2/1942 | Strong et al. | 312/100 |
| 3,039,835 | 6/1962 | Liedeker, Jr. | 312/100 |
| 3,669,037 | 6/1972 | Rossel | 109/49 |
| 4,179,169 | 12/1979 | Daniels et al. | 312/257 A X |
| 4,288,132 | 9/1981 | Znamirowski et al. | 312/257 SM X |

*Primary Examiner*—Robert P. Swiatek
*Attorney, Agent, or Firm*—McDougall, Hersh & Scott

[57] ABSTRACT

A case for securing valuables which includes a plurality of interconnected panels defining an interior space for location of the valuables. A door provides access to the space and a lock normally maintains the door in the closed position to prevent such access. Some of the panels employed for forming the space include inside facing surfaces and connectors such as threaded studs are positioned on these surfaces. Cooperating connectors such as openings for receiving the studs are defined by other panels so that upon assembly of the respective panels, access to the connectors is available only from within the interior of the case. The individual panels are readily transportable for convenient location and assembly; however, the case, once assembled, cannot be so readily moved from its location.

10 Claims, 6 Drawing Figures

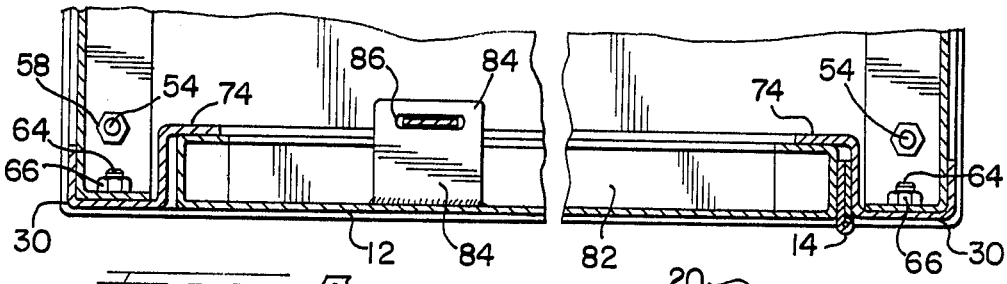
FIG. 5
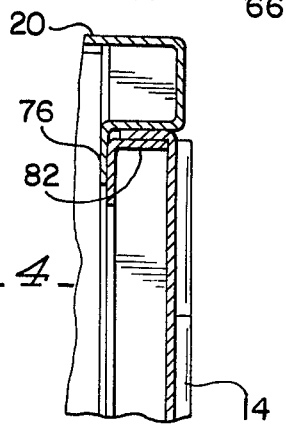
FIG. 4
FIG. 6
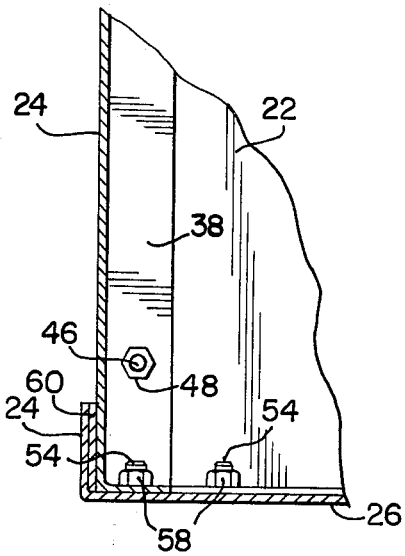
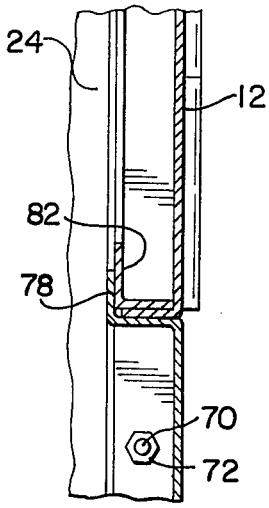
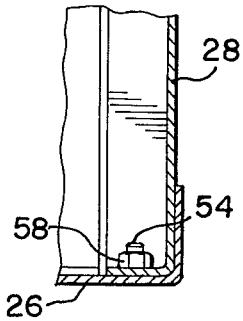

CASE FOR SECURING VALUABLES

BACKGROUND OF THE INVENTION

This invention relates to a case designed for storing and securing valuables. Generally speaking, the case is intended for use in residences or small business where it would be unduly expensive or impractical to purchase a safe of available design.

In addition to the fact that safes of common design are generally considered expensive, such safes are quite heavy, and not readily transportable by individuals who might wish to secure valuables in a home or similar location. This is particularly true where it is preferred that the valuables be stored on an upper level in a residence.

Where cases in the form of cabinets, chests, etc., are reasonably transportable, the cases usually suffer from deficiencies from the standpoint of security. Filing cabinets, dressers, and chests and the like are commonly provided with locks; however, such locks can typically be easily bypassed. For example, it is not uncommon for one to break into such structures with a crowbar or other tool, and since this could normally be accomplished with minimum delay, the security of such structures is not of great significance. Such structures may serve, for example, to prevent access by children, but would not be suitable to prevent theft. In the latter connection, where the structures are portable enough to be easily handled by individuals, the entire structure could also be readily transported by thieves.

SUMMARY OF THE INVENTION

In accordance with this invention, a case is provided which overcomes the aforementioned problems. Specifically, the case is characterized by suitable portability so that it can be located without undue effort in any desired location such as on an upper floor of a residence. The portability is such that a single individual would typically be able to locate the case in a desired place.

Once located, the case is characterized by features which greatly minimize the possibility of unauthorized access to the case or removal of the case from the premises. Thus, the case is provided with a high security locking system and is designed to eliminate or at least greatly minimize entry into the case by means of a crowbar or other tool.

The case is not readily removed once located for use since it is designed for on-site assembly. Thus, the structure is formed from a plurality of individual panels which can be transported to the desired location and then assembled into a unit which will be of a size and weight preventing, for practical purposes, removal from the site by less than a number of individuals.

A particularly advantageous feature of the invention involves the fact that the panels and other structural elements making up the case can be readily assembled by unskilled individuals. More significantly, the connectors employed for securing the structural elements together are such that the connectors are not accessible from the outside of the case. Accordingly, once the case is assembled and locked, it cannot be disassembled unless one gains access to the interior of the case.

The case of the invention more specifically consists of panels which define inside facing surfaces carrying a plurality of connectors such as inwardly extending studs. These studs may be welded to the inside facing surfaces and will typically comprise threaded members.

Other adjacent panels define openings for receiving the studs whereby the panels are bolted together with access to these connections being provided only from the interior of the case.

In the preferred form of the invention, side panels of the case define openings on all edges for receiving studs located on top, bottom, front and rear panels. The front includes corner posts with an opening define therebetween for receiving the door of the case. As will be appreciated, the width of the front surface of these corner posts may be varied depending upon the size of the door desired.

In addition to the front surface defined by the corner posts, an additional panel may be provided at the front of the case beneath the door. This panel will be coextensive with the door between the corner posts and may define openings for receiving studs mounted on the corner posts to thereby secure the front panel in place.

A door hinge of common design may be connected between a corner post and a door edge so that the door can swing open and closed about the vertical axis of the hinge. Lock structures of various common designs may be employed in association with the door; however, the over-all design of the case is particularly susceptible to the use of a lock structure which provides locking engagement at multiple points for maximum security.

In order to prevent or at least minimize the possibility of penetration into the interior by means of a tool, a plurality of lips are formed around the periphery of the door whereby the back of the door will be positioned adjacent these lips when closed. The respective lips thus cover the narrow openings which would otherwise be provided into the interior of the case, and therefore, provide a barrier to the entry of a prying tool which one might attempt to use for unauthorized entry.

The features described are accomplished by the use of sheet metal members which can be formed into the desired shapes with a minimum of tooling and operating expense. Specifically, the various panels as well as the door may be formed from flat sheets operated on by conventional metal bending equipment. The configurations of the respective members thus provide the desired convenience and security while at the same time being available at minimum cost.

BRIEF DESCRIPTION OF THE DRAWINGS

FIG. 4 is an enlarged, fragmentary, vertical, sectional view taken about the line 4—4 of FIG. 1;

FIG. 5 is an enlarged fragmentary, horizontal sectional view taken about the line 5—5 of FIG. 1; and, FIG. 6 is an enlarged fragmentary, cross-sectional view taken about the line 6—6 of FIG. 1.

DESCRIPTION OF THE PREFERRED EMBODIMENTS

Figure 2:
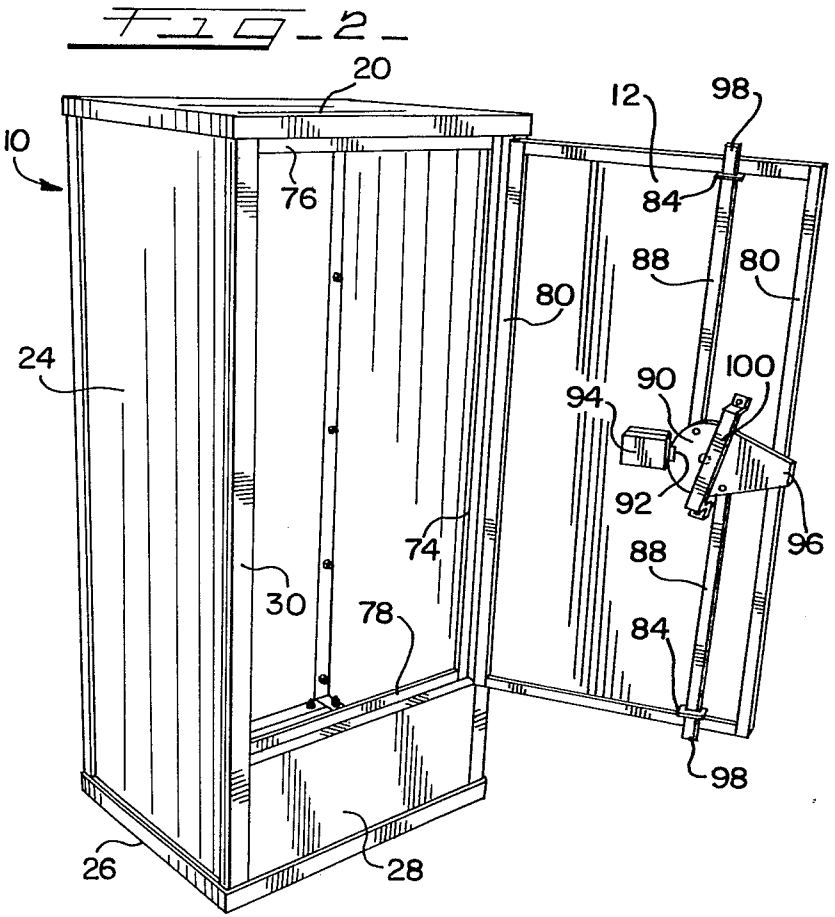
FIG. 2 is a perspective view of the case with the door open.
Figure 1:
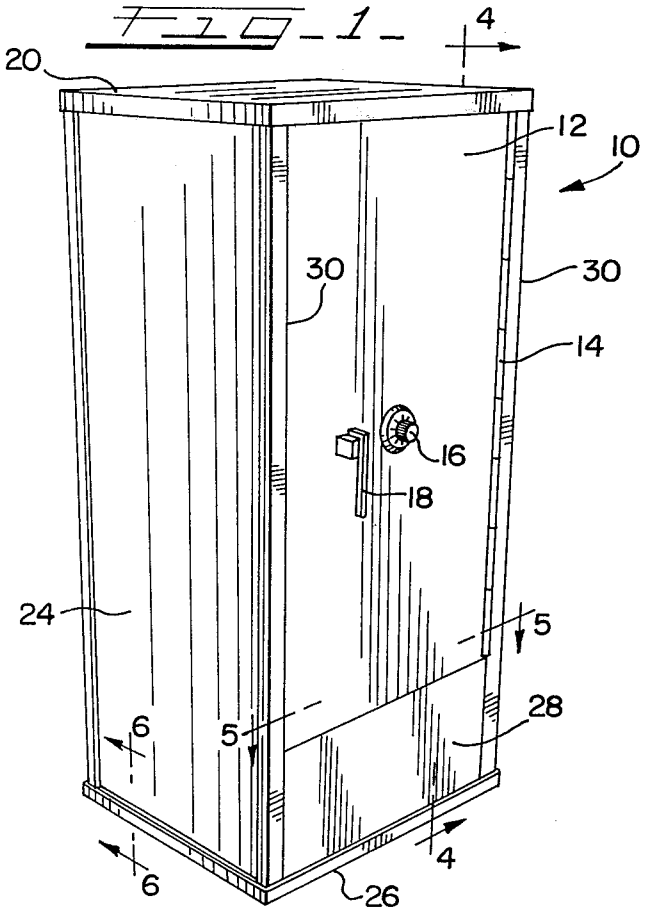
FIG. 1 is a perspective view of a case characterized by the features of this invention.

FIGS. 1 and 2 illustrate a case of generally rectangular construction. The case includes a door 12 which swings between open and closed positions about vertically extending hinge 14. A combination lock 16 works in cooperation with handle 18 to provide for locking of the door in the closed position and for opening of the door when access is desired.

The case is illustrated empty, and it will be appreciated that a variety of conventional means could be utilized in the interior of the case to accommodate storage of valuables of many different types. For example, the interior could be provided with shelves or brackets for supporting a variety of different valuable items. Individual drawers could also be readily mounted within the case, and a variety of other interior structures could also be employed. It will be further understood that the use of a single door mounted on a vertical hinge for exposing the interior is not a limiting aspect of the invention.

Figure 3:
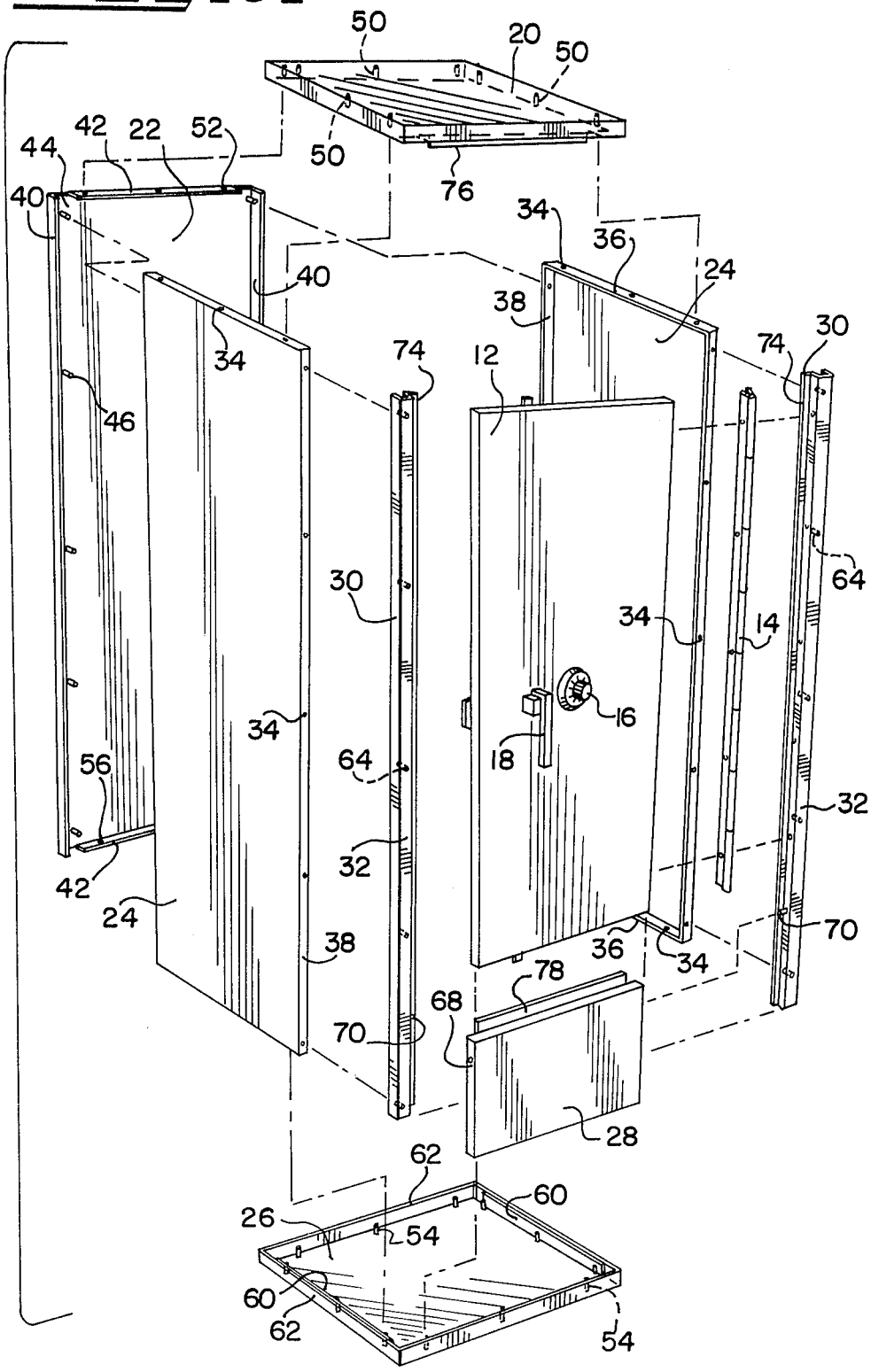
FIG. 3 is an exploded view of the case illustrating the various structural elements making up the assembly.

As best shown in FIG. 3, the case of the invention includes a plurality of panels comprising a top panel 20, a back panel 22, a pair of side panels 24, a bottom panel 26 and a front panel 28. A pair of corner posts 30 each include a front surface 32 which combines with the front panel 28 and top panel 20 to define an opening for mounting of the door 12. It will be appreciated that the surfaces 32 of the post 30 may vary in width to thereby provide more extensive front panel surfaces, and a corresponding decrease in the width of the door 12. Similarly, a top front panel corresponding in design to the panel 28 could be located beneath top panel 20 with a corresponding decrease in the height of the door 12.

The respective side panels 24 define a plurality of openings 34 along their top, bottom and side edges. The panel 24 is preferably formed from a flat sheet of metal with the side edges being provided by forming right angle portions 36 along the top and bottom, and right angle portions 38 along the sides.

Back panel 22 is also preferably formed from sheet metal and includes right angle bends 40 along each side. Right angle bends 42 are formed along the top and bottom edges, and the sheet metal is initially cut to include gaps 44 between the bends 40 and 42 so that the side panel 24 will interfit with the back panel.

The back panel 22 defines a plurality of studs 46 adapted for receipt in openings 34 of the side panels. The studs 46 are preferably threaded so that bolts 48 may be attached thereto as shown in FIG. 6.

Top panel 20 supports a plurality of supporting studs 50 adapted to be received in openings 52 which are defined by the right angle bend 42 of back panel 22. Additional studs 50 supported by the top panel 20 are receivable within the openings 34 defined along the top edge of side panels 24.

The bottom panel 26 supports studs 54 which are receivable within openings 34 defined along the bottom edges of side panels 24 and also within openings 56 defined by right angle bend 42 of back panel 22. Bolts 58 are employed for securing the respective panels together as shown in FIG. 6. In the course of completing this bottom assembly, filler plates 60 are located between the right angle bends 62 defined by the bottom panel and the exterior surfaces of side panels 24. This arrangement eliminates any gap along the bottom side edges of the case.

Corner posts 30 support studs 64 which are receivable within openings 34 of respective side panels 24. The assembly of the corner posts with the side panels is completed by means of nuts 64 as shown in FIG. 5.

Front panel 28 defines openings 68 for receiving additional studs 70 carried by the corner posts. Nuts 72, as shown in FIG. 4, serve to complete this assembly.

The various studs are preferably welded to the respective panels although other means for mounting studs or comparable connectors could be utilized. The studs shown are threaded for receiving conventional hex nuts to simplify the assembly operation for a home owner or the like. It will be appreciated, however, that other connecting systems could be utilized.

The vertically extending hinge 14 is of conventional design and is adapted to be attached to the adjacent corner post and door edge by means of conventional sheet metal screws. Again, skilled technique is not required for purposes of achieving such an assembly operation.

The opposite corner post along with the top panel 20 and front panel 28 define the opening for receiving the door 12. It will be noted that each corner post includes an in-turned lip portion 74 which serves as a seat for the side edge of the door. A down-turned lip 76 is defined by top panel 20 while an up-turned lip 78 is defined by front panel 28. The combination of the respective lip portions defines a frame against which the back edges of the door 12 rest when the door is closed. It will be appreciated that narrow openings are defined between the mating edges of the door and surrounding panel edges, and this provides potential for penetration of a tool into the interior space which could then be used for prying open the door, or for engaging the bolts or other locking mechanisms associated with the door. The frame provided by these lip members provides a barrier to the penetration of such tools whereby this problem is eliminated.

As in the case of the other panels, the top panel 20 and front panel 28 may be made of sheet metal having 90° bends for forming the respective panel side edges. A double bend is then utilized for forming the respective lips 76 and 78.

The corner posts 30 could also be formed on a bending press or by means of a roll forming operation. In either event, the cross section of these posts is readily obtained utilizing conventional and relatively inexpensive sheet metal forming operations.

The door 12 also comprises a sheet metal member having right angle bends around the periphery. In this instance, however, the side edges of the door include return portions 80 which provide additional strength. Furthermore, horizontally located stiffeners 82 are positioned along the top and bottom edges of the door to increase the door strength. These stiffeners may be spot welded or otherwise secured in place at the point of manufacture.

In the embodiment of the invention shown, members 84 defining slots 86 are welded to the door adjacent the top and bottom edges. A pair of rods 88 define outer ends receivable within the respective slots and inner ends attached to cam 90. The cam 90 is adapted to engage the bolts 92 mounted in the combination lock housing 94. It will be appreciated that in accordance with conventional operation, the setting of the lock by using the proper combination will permit movement of the cam 90 relative to bolt 92. In the absence of the proper combination, the cam will be secured against movement by means of the bolt 92. It will be appreciated that the lock mechanism illustrated does not form a part of this invention, and that other mechanisms capable of achieving a similar function may be utilized.

The end 96 of cam 90 is adapted to extend behind lip 74 of the adjacent corner post 30 when the door is closed. Similarly, the respective ends 98 of rods 88 are adapted to extend behind lips 76 and 78. This provides for securing of the door at three separate locations to effectively prevent access when the door is locked.

When the handle 18 is free for rotation, the cam 90 will be moved counterclockwise to simultaneously free the door at all locking points. A bracket 100 extends over cam 90 to limit its degree of rotation in order to minimize possible damage in this area.

In practice, the structural elements of the case may be packaged in a manner most convenient for shipping and handling. As previously indicated, maximum advantage can be achieved when the case is received by a potential user in an unassembled condition so that the user can transport the individual parts to any desired location. It is contemplated that the various panels and door be manufactured from sheet metal of a thickness in the order of 10 to 15 gauge and that the assembled case have a height from 4 to 6 feet and a width of 1½ to 3 feet. Accordingly, none of the individual pieces will be difficult for an individual to transport; however, the fully assembled case will be quite heavy, particularly with valuables inside, and will, therefore, be difficult to move.

When it is considered that it will also be extremely difficult for an unauthorized person to gain access to the assembled case, it will be appreciated that the construction of the invention substantially eliminates problems associated with prior art arrangements.

It will be understood that various changes and modifications may be made in the above-described construction which provide the characteristics of the invention without departing from the spirit thereof particularly as defined in the following claims.

I claim:

1. A case for securing valuables comprising a plurality of interconnected panels defining an interior space for placement of the valuables, a door providing access to said space, and a lock for said door, at least some of said panels supporting connectors on inside facing surfaces thereof, and cooperating connectors associated with the remaining panels, all of said connectors on said inside facing surfaces comprising a plurality of spaced-apart, inwardly extending studs attached to said inside facing surfaces and having no portions thereof on outside facing surfaces of said panels, said cooperating connectors comprising openings defined by the remaining panels dimensioned to receive said studs, said case being thereby free of any connectors for holding the panels together which are exposed on the exterior of the case, whereby, upon assembly of the respective panels, access to the connectors is available only from within said interior space.

2. A case in accordance with claim 1 wherein said panels are separately transportable by an individual, but wherein said case, when in the assembled condition, is not readily transportable by an individual.

3. A case in accordance with claim 1 wherein said studs comprise threaded members with bolts mounted on said studs for securing the panels together.

4. A case in accordance with claim 1 wherein said studs are welded to said inside facing surfaces.

5. A case in accordance with claim 1 wherein said panels include oppositely disposed side panels, said openings being defined along edges of said side panels, and additional panels defining respective top, bottom, front and rear surfaces positioned adjacent said edges of said side panels, said studs being supported on said top, bottom, front and rear surfaces.

6. A case in accordance with claim 5 including a pair of front corner posts defining a portion of said front surfaces, said corner posts defining the opposite side edges of the opening provided for receiving said door.

7. A case in accordance with claim 6 including a front panel defining an additional portion of the front surface, the top edge of said panel extending between said corner posts for defining the bottom edge of the opening receiving said door.

8. A case for securing valuables comprising a plurality of interconnected panels defining an interior space for placement of the valuables, a door providing access to said space, and a lock for said door, at least some of said panels supporting connectors on inside facing surfaces thereof, and cooperating connectors associated with other panels, said connectors on said inside facing surfaces comprising a plurality of spaced-apart, inwardly extending studs, said cooperating connectors comprising openings defined by the other panels dimensioned to receive said studs, said panels including oppositely disposed side panels, said openings being defined along edges of said side panels, and additional panels defining respective top, bottom, front and rear surfaces positioned adjacent said edges of said side panels, said studs being supported on said top, bottom, front and rear surfaces, and including a pair of front corner posts defining a portion of said front surfaces, said corner posts defining the opposite side edges of the opening provided for receiving said door, a front panel located adjacent the bottom of the case and defining an additional portion of the front surface, the top edge of said front panel extending between said corner posts for defining the bottom edge of the opening receiving said door, and including lips defined by the respective corner posts and by said front panel, said lips extending beyond said edges defining the opening of said door and being located behind said door when the door is closed to thereby prevent penetration of any implement beyond said door into said interior space, whereby, upon assembly of the respective panels, access to the connectors is available only from within said interior space.

9. A case in accordance with claim 8 including a top panel defining a front edge which forms the top edge of the opening for said door, said top panel having a lip extending downwardly from said front edge and positioned behind said door when the door is closed to thereby prevent penetration of any implement beyond said door into said interior space.

10. A case for securing valuables comprising a plurality of interconnected sheet metal panels defining an interior space for placement of the valuables, a door providing access to said space, and a lock for said door, at least some of said panels supporting connectors on inside facing surfaces thereof, and cooperating connectors associated with other panels, said connectors on said inside facing surfaces comprising a plurality of spaced-apart, inwardly extending, threaded studs welded to said inside facing surfaces, said cooperating connectors comprising openings defined by said other panels, said openings being dimensioned to receive said studs, said sheet metal panels including a pair of front corner posts defining a portion of said front surfaces, said corner posts defining the opposite side edges of the opening provided for receiving said door, respective ones of said panels defining the top and bottom edges of the door opening, and including bends defined by the respective corner posts and by said panels defining the top and bottom edges of the door opening, said openings being defined by said bends and additional bends extending away from said first-mentioned bends and comprising lips extending beyond said edges defining the opening of said door, said lips being located behind said door when the door is closed to thereby prevent penetration of any implement beyond said door into said interior space, and whereby, upon assembly of the respective panels, access to the connectors is available only from within said interior space, and wherein said first-mentioned bends are formed along the side edges of the panels to provide strength and for interfitting with adjacent panels, said panels being separately transportable by an individual, but the case, when in the assembled condition, not being readily transportable by an individual.

* * * * *